US009663878B2

(12) United States Patent
Fischer

(10) Patent No.: US 9,663,878 B2
(45) **Date of Patent: *May 30, 2017**

(54) AIR JET SPINNING MACHINE AND METHOD FOR OPERATING IT

(71) Applicant: Maschinenfabrik Rieter AG, Winterthur (CH)

(72) Inventor: Andreas Fischer, Steckborn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/737,690

(22) Filed: Jun. 12, 2015

(65) Prior Publication Data

US 2015/0361594 A1 Dec. 17, 2015

(30) Foreign Application Priority Data

Jun. 12, 2014 (CH) ..... 0888/14

(51) Int. Cl.
*D01H 13/32* (2006.01)
*D01H 4/02* (2006.01)
(Continued)

(52) U.S. Cl.
CPC ..... *D01H 13/32* (2013.01); *D01H 1/115* (2013.01); *D01H 4/02* (2013.01); *D01H 13/22* (2013.01);
(Continued)

(58) Field of Classification Search
CPC ..... D01H 4/02; D01H 13/22; D01H 3/306; D01H 3/32
See application file for complete search history.

(56) References Cited

U.S. PATENT DOCUMENTS 4,051,651 A * 10/1977 Wahlen ..... D01H 13/306 57/296
5,421,529 A * 6/1995 Hans ..... B65H 63/0322 15/214
(Continued)

FOREIGN PATENT DOCUMENTS

CN 102162156 A 8/2011
DE 10256293 A1 6/2004
(Continued)

OTHER PUBLICATIONS

Swiss Patent Office Search Report, dated Sep. 5, 2014.
European Patent Office Search Report, dated Nov. 6. 2015.

*Primary Examiner* — Shaun R Hurley
(74) *Attorney, Agent, or Firm* — Dority & Manning, P.A.

(57) ABSTRACT

A method is provided to operate an air jet spinning machine, having at least one spinning unit with a spinning nozzle for manufacturing yarn, in which a fiber strand is fed to the spinning nozzle through an inlet and is imparted a twist inside a vortex chamber of the spinning nozzle by means of a swirled air current so that a yarn is formed from the fiber strand. An additive is added with an additive dispenser to the spinning unit while the air jet spinning machine is operating and applied on the fiber strand or on sections of the spinning nozzle and/or the yarn. At least one physical parameter of the yarn is monitored by a sensor system wherein, based on a measured value supplied by the sensor system correlated with the parameter, it is determined whether and/or how much additive was applied.

11 Claims, 3 Drawing Sheets

(51) Int. Cl.
*D01H 13/30* (2006.01)
*D01H 1/115* (2006.01)
*D01H 13/22* (2006.01)

(52) U.S. Cl.
CPC ..... *D01H 13/304* (2013.01); *D01H 13/306* (2013.01)

(56) References Cited

U.S. PATENT DOCUMENTS

| | | | | |
|---|---|---|---|---|
| 6,571,620 | B2 * | 6/2003 | Moisio | G01B 21/06 73/159 |
| 2002/0050039 | A1 * | 5/2002 | Kutsenko | D01D 5/096 28/274 |
| 2014/0283496 | A1 * | 9/2014 | Stahlecker | D01H 4/48 57/263 |
| 2015/0283746 | A1 * | 10/2015 | Schaffler | B29C 47/0014 425/319 |
| 2015/0283747 | A1 * | 10/2015 | Hofmann | B29C 47/0014 425/319 |
| 2015/0284878 | A1 * | 10/2015 | Kubler | D01D 5/06 425/461 |
| 2015/0361592 | A1 * | 12/2015 | Schaffler | D01H 4/02 57/403 |
| 2015/0361594 | A1 * | 12/2015 | Fischer | D01H 13/32 53/296 |

FOREIGN PATENT DOCUMENTS

| | | | |
|---|---|---|---|
| EP | 2 302 114 | A2 | 3/2011 |
| EP | 2 450 478 | A2 | 5/2012 |
| EP | 2 573 256 | A2 | 3/2013 |
| JP | H10130970 | A | 5/1998 |
| JP | H10195711 | A | 7/1998 |
| JP | 2000146866 | A | 5/2000 |
| JP | 2013160678 | A | 8/2013 |
| WO | WO 2005/033697 | A1 | 4/2005 |

* cited by examiner

AIR JET SPINNING MACHINE AND METHOD FOR OPERATING IT

FIELD OF THE INVENTION

The present invention refers to a method to operate an air jet spinning machine that has at least one spinning unit with a spinning nozzle for manufacturing yarn, in which case a fiber strand is fed to the spinning nozzle through an inlet during the operation of the spinning unit so that the fiber strand is twisted inside a vortex chamber of the spinning nozzle with the help of a swirled air current, thereby forming a yarn from the fiber strand that finally leaves the spinning nozzle through an outlet. With the help of an additive supply, an additive is added, at least temporarily, to the spinning unit while the air jet spinning machine is being operated, and applied on the fiber strand and/or the yarn or on parts of the spinning nozzle.

Moreover, an air jet spinning machine is suggested that has at least one spinning unit equipped with a spinning nozzle to manufacture yarn from a fiber strand fed to the spinning nozzle, which has an inlet for the fiber strand, a vortex chamber lying inside, a yarn forming element protruding into the vortex chamber, and an outlet for the yarn produced inside the vortex chamber with the help of a swirled air current. An additive supply is allocated to the spinning unit by which an additive is supplied, at least temporarily, to the spinning unit while it is operating and that can be applied on any combination of the fiber strand, the yarn, or on parts of the spinning nozzle.

BACKGROUND

Air jet spinning machines with the corresponding spinning units are known from the state of the art and serve to manufacture yarn from an elongated fiber strand. Here, with the help of a swirled air current generated inside the vortex chamber by the air nozzles, the outer fibers of the fiber strand are wound around the core fibers lying inside in the area of an inlet orifice of the yarn forming element to finally form the wrap fibers decisive for providing the yarn with the desired strength. The result is a yarn with a real twist that is finally led out of the vortex chamber through a draw-off channel and can be wound up on a tube, for example.

Generally, within the meaning of the invention, the term yarn is understood to be a fiber strand in which at least some of the fibers are wound around an inner core. Thus, the term encompasses a yarn in the conventional meaning that can be processed to a fabric, for example, with the help of a weaving machine. However, the invention also refers to air jet spinning machines used to manufacture so-called rove (another name: sliver). This kind of yarn is characterized by being capable of drafting in spite of having certain strength sufficient for transporting the yarn to a subsequent textile machine. Thus, the rove can be drafted with the help of a drafting mechanism (e.g. the drafting system of a textile machine that processes the rove such as a ring spinning machine) before it is finally spun.

In the manufacturing of synthetic fibers such as polyester or a combination of natural and synthetic fibers, deposits are formed on the surface of the yarn forming element. The manufacturing of synthetic fibers encompasses a so-called preparation of the continuous filaments during the manufacturing process. The preparation consists of applying a preparation agent (generally oils with various additives) to allow treatment that can involve drafting the continuous filaments under high rates. These preparation agents continue to adhere partially on the synthetic fibers even in further processing and cause impurities in the air jet spinning machine. The fibers fed to the air jet spinning machine in form of a fiber strand are generally supplied to the spinning nozzle by a pair of delivery rollers. The pair of delivery rollers can correspond to a front roller pair of a drafting system, which is used to improve the fiber strand presented before it enters the spinning nozzle.

As a rule, a fiber guiding element is arranged in the inlet area of the spinning nozzle through which the fiber strand is guided into the spinning nozzle and finally into the area of the yarn forming element. Spindles having an inner draw-off channel are used most of the time as yarn forming elements. Compressed air is introduced in such a way on the top of the yarn forming element through the housing wall of the spinning nozzle that the above-mentioned rotating swirled air current is generated. This causes the individual outer fibers coming out of the fiber guiding element to be severed and turned over above the tip of the yarn forming element. Later, these detached fibers rotate on the surface of the yarn forming element. Subsequently, the forward movement of the inner core fibers of the fiber strand makes the rotating fibers wind around the core fibers, thus forming the yarn. However, the movement of the individual fibers over the surface of the yarn forming element also causes deposits to form on the yarn forming element owing to adhesions on the fibers from the manufacturing process. Deposits on the yarn forming element can also be caused by damaged fibers. For the same reasons, deposits can also form on the surface of the spinning nozzle's interior or of the fiber guiding element. These adhesions are detrimental to the surface finish of the yarn forming element and lower the quality of the manufactured yarn. Therefore, regular cleaning of the affected surfaces becomes necessary to maintain the same quality of the spun yarn.

The surfaces of the yarn forming element, of the interior of the spinning nozzle and of the yarn guiding element can be cleaned manually by disassembling the yarn forming element periodically, but this involves significant maintenance work coupled with the corresponding operational downtime.

On the other hand, EP 2 450 478 describes equipment capable of cleaning the machine automatically without shutting down the machine. To accomplish this, an additive is added to the compressed air used inside the spinning nozzle for producing the swirled air current. The additive is guided through the compressed air towards the yarn forming element, where it cleans its surface.

It is also possible to apply the additive on the fiber strand, on parts of the spinning nozzle or the yarn produced from it, in order to improve the properties of the manufactured yarn, such as its hairiness. Furthermore, if the corresponding quantity of additive is added, higher production speeds can be achieved so the machine can also produce more economically and energy can be saved.

SUMMARY OF THE INVENTION

A task of the present invention is therefore to further develop the addition of the additive known from the state of the art and to suggest a corresponding air jet spinning machine used to implement this further development. Additional objects and advantages of the invention will be set forth in part in the following description, or may be obvious from the description, or may be learned through practice of the invention.

The objects are solved by a method and an air jet spinning machine having the characteristics described and claimed herein.

According to the invention, the method for operating an air jet spinning machine is characterized by the fact that the yarn coming out of the spinning nozzle through the outlet is monitored with the help of a sensor system to determine at least one physical parameter, through which it is determined whether and/or how much additive was applied on the fiber strand or the yarn produced from it passing through the sensor system, based on at least one measured value delivered by the sensor system correlated with the above-mentioned parameter.

Generally, the monitoring according to the invention can take place during normal operation while the spinning nozzle is producing yarn and the additive supplied serves to improve yarn properties. Additionally or alternately, it is just as possible to monitor the addition of additive during a cleaning operation of the spinning unit, during which the additive is used for the cleaning purpose described above.

Whereas the addition of additive taking place in the state of the art was apportioned quantitatively, this invention now allows the qualitative and/or quantitative addition of additive to be monitored and to change the volumetric or mass flow of the added additive while it is still being added. Incidentally, the addition of the additive can be done in the spinning nozzle inlet area or also within it.

Now, the above-mentioned monitoring does not take place by measuring the additive volumetric or mass flow inside an additive pipe supplying the additive to the spinning nozzle. Rather, the invention suggests an indirect monitoring in which the addition of additive is recognized and/or determined quantitatively by means of changes in one or several selected yarn parameters. Basically, these parameters can be all physically measurable yarn properties that undergo a qualitative or quantitative change owing to the addition of the additive. For example, it could be possible to monitor so-called yarn hairiness—a measure of the fiber ends or fiber loops sticking out from the yarn body—in which case the addition of an additive entails, in principle, a decrease of hairiness because the additive makes the protruding fiber parts stick to the yarn body. Likewise, the mass per unit length (=mass of the yarn body formed by the fiber material plus mass of the added additive) changes and perhaps the yarn thickness too when the additive is added, so these parameters can also be monitored with the help of a corresponding sensor system. Naturally, other parameters can also be monitored such as, for example, mass and/or thickness fluctuations, light reflection capacity, light absorption capacity, yarn structure uniformity, etc., so all physical parameters influenced by the added additive can be considered.

In any case, the monitoring of the corresponding parameters allows one to state whether—and if applicable, how much—additive is added during normal and/or cleaning operation. By the way, the additive used can be made of liquid or solid ingredients (or mixtures thereof), but water or an aqueous solution is preferable.

It is especially advantageous if yarn manufacturing is interrupted with the help of a control unit when the additive supply detected with the help of the sensor system deviates qualitatively and/or quantitatively in a defined way from the respective target values. This prevents that during normal operation—during which actually an addition of additive should take place—yarn is produced on which too little or no additive was applied on its fibers owing to a lack of additive delivery. The same applies to the cleaning operation. Here, too, an interruption of yarn manufacturing or repetition of a cleaning sequence can take place if the measured values transmitted by the sensor system lie outside defined limits.

It is particularly advantageous if the sensor system comprises an optical sensor used to monitor yarn, in which case a qualitative monitoring of additive supply based on the values measured by the optical sensor takes place. For example, it could be conceivable to monitor the yarn hairiness mentioned above with the help of the optical sensor, in which case the yarn length-related number of free fiber ends sticking out, their individual or averaged length or also the change of the above-mentioned magnitudes can be taken into account. With the help of optical sensors it is also possible to monitor light absorption or reflection or even the size of the yarn shadow with the corresponding lighting, which can change when the additive is added. Furthermore, this allows yarn thickness or some of its other geometrical properties (which can be detected optically and whose amounts depend on the addition of the additive) to be recorded.

It is additionally advantageous if the sensor system comprises a capacitive sensor used for monitoring yarn mass. The quantitative monitoring of the addition of additive takes place based on the measured values provided by the capacitive sensor. Since the mass of the yarn passing the sensor is made up from the mass of the yarn body consisting of the fiber material of the fiber strand and the applied additive, with the help of the capacitive sensor, it is possible to monitor the quality—and especially the quantity—of the added additive under otherwise equal spinning conditions. Thus, the monitoring allows one not only to state that additive was added, but how much of it too.

In principle, it should be pointed out here that the sensor system can naturally comprise additional or alternate sensors used to monitor the yarn's individual physical properties. For example, it could be possible to provide several sensors to record different optical qualities of the yarn. Moreover, several capacitive sensors can be installed to monitor several yarn properties that can be measured in a capacitive way. It is also possible to retrieve several channels of one sensor and evaluate them separately with the help of the control unit. It would thus be conceivable to utilize one channel of the capacitive sensor to represent the recorded measured values graphically on a display, while another channel is connected directly to the control unit that also monitors or controls the individual functions of the corresponding spinning unit. Finally, individual sensors or channels of the corresponding sensors could serve to monitor the addition of the additive, while other sensors or channels allow the monitoring of the yarn for undesired yarn errors (short or long thick or thin parts, etc.). Generally speaking, it would finally be possible to position several sensors on different spots, although according to the invention, it would be preferable to combine all sensors of the sensor system to a structural unit located in the yarn path between the outlet of the spinning nozzle and the winding device installed downstream in the yarn's transportation direction. It is therefore quite possible for a so-called yarn clearer to assume the sensor system's function, known from the state of the art and that to date has assumed only the function of detecting yarn errors.

It is moreover extremely advantageous if the additive is fed in pulse-like fashion, in which case the quantitative monitoring of additive supply takes place by evaluating the yarn's short-time mass fluctuations detected by the capacitive sensor. For example, it could be conceivable for the additive supply on the fiber strand or the additive dispenser for the yarn or the additive supply line with an additive deposit connected to the additive dispenser to have a dosing unit that opens and closes several times per second. In this case, the additive would be applied on the fiber strand or yarn not as uniform additive flow, but rather in form of many individual doses. As a result of this, many tiny mass fluctuations of the yarn would occur that could be detected with the help of a capacitive sensor. Finally, by evaluating the measured values, especially their averaging, a reliable statement about the addition of the additive or the quantity of the added additive can be made.

It is also advantageous if the volumetric flow of the supplied additive reaches a value between 0.001 mL/min and 7.0 mL/min, preferably between 0.02 mL/min and 5.0 mL/min, very preferably between 0.05 and 3.0 mL/min, and/or that the mass flow of the supplied additive reaches a value, at least temporarily, between 0.001 g/min and 7.0 g/min, preferably between 0.02 g/min and 5.0 g/min, very preferably between 0.05 g/min and 3.0 g/min. Whereas higher values allow a cleaning of the individual parts of the spinning unit or of the sections of the additive supply perfused by the additive, smaller values are advantageous during normal operation because the additive merely serves to improve yarn properties (its hairiness, strength, flexibility and uniformity). The dosing unit should therefore allow a volumetric or mass flow over the ranges mentioned above so the individual spinning units can be operated both in normal and cleaning operation.

It is especially advantageous if the volumetric flow (or mass flow) of the supplied additive while the spinning unit is operating normally has a value between 0.001 mL/min (or g/min) and 1.5 mL/min (or g/min), preferably between 0.01 mL/min (or g/min) and 1.0 mL/min (or g/min) and while the spinning unit is operating in cleaning mode between 2.0 mL/min (or g/min) and 7.0 mL/min (or g/min), preferably between 3.0 mL/min (or g/min) and 7.0 mL/min (or g/min).

The exact value can be selected depending on the properties of the fiber strand and/or its feeding speed into the spinning unit and/or the yarn's draw-off speed out of the spinning unit. It can therefore fluctuate according to the specific application. Likewise, the value intended for cleaning operation can be selected depending on the duration of the cleaning operation or the normal operation between two cleaning steps.

It is additionally advantageous if the yarn is also monitored to that effect with the help of the sensor system, to check whether the yarn's thickness and/or mass values lie above or below stipulated limits, in which case the sensor system is connected to a control unit of the air jet spinning machine and the control unit interrupts yarn production as soon as at least one of the values falls above or below the limits. In this case, the sensor system serves not only for monitoring the addition of additive, but rather it is also used to monitor whether yarn manufacturing is basically complying with specifications. For example, if the yarn has too many long or frequent thin parts that are not caused by a lack of additive, this indicates that yarn manufacturing is not taking place smoothly in the spinning nozzle. Also, the signals of several sensors or their individual channels could be evaluated in a combined way to carry out a quality control in addition to checking the additive added. If, for example, the capacitive sensor would detect an unusual increase or fluctuation of mass even though the optical sensor indicates that the additive is being added uniformly, then this should be evaluated as an indication of poor yarn quality.

It is also advantageous if the mass and/or volumetric flow of the supplied additive is higher during a cleaning operation than during normal operation, in which case at least one of the limits mentioned in the previous paragraph, in which yarn manufacturing is interrupted when the value falls under or above the limits, has another value during cleaning operation than during normal operation. If the limits would be maintained constant, then an increase in the additive quantity added during the cleaning operation would indicate a thick part or unacceptable change of another physical yarn parameter and yarn manufacturing would be interrupted even though the additive addition and yarn manufacturing during the cleaning operation actually complied with specifications. It would therefore make sense, for example, to increase the upper limit of the length-related mass, in which yarn manufacturing is interrupted, during cleaning operation compared to normal operation because the yarn mass is necessarily increased during the cleaning operation because more additive is added. Likewise, the corresponding lower limit should be increased to detect a lower addition of additive as well so yarn manufacturing can be interrupted when a correspondingly adjusted value is not reached. In principle, it therefore makes sense to select the respective limits for normal and cleaning operation at different levels. In this context it should be pointed out, however, that this procedure pertains especially to the quantitative monitoring of the addition of additive. On the other hand, the limits of the measured values supplied by a sensor that merely monitors the qualitative addition of additive can be equally high (as long as additive is added both during normal and cleaning operation and the measured values of the corresponding sensor are evaluated only to check whether additive is being added or not).

Finally, the spinning unit of the air jet spinning machine according to the invention comprises a sensor system with which at least one physical parameter of the yarn leaving the outlet of the spinning nozzle can be monitored. Here, a control unit is allocated to the spinning unit and made to determine whether and/or how much additive was applied on the fiber strand or the yarn manufactured from it that passes through the sensor system, based at least on one measured value correlating with the above-mentioned parameter supplied by the sensor system. Regarding possible advantageous designs of the monitoring or possible sensor system features or the evaluation of the measured values transmitted by the sensor system, reference is made to the description given above or below. Generally, it should be pointed out here that the control unit can be designed to operate the air jet spinning machine according to the individually described method characteristics, although they can be implemented individually or in any combination.

BRIEF DESCRIPTION OF THE FIGURES

The following embodiments describe further advantages of the invention, which show in each case schematically.

DETAILED DESCRIPTION

Figure 1:
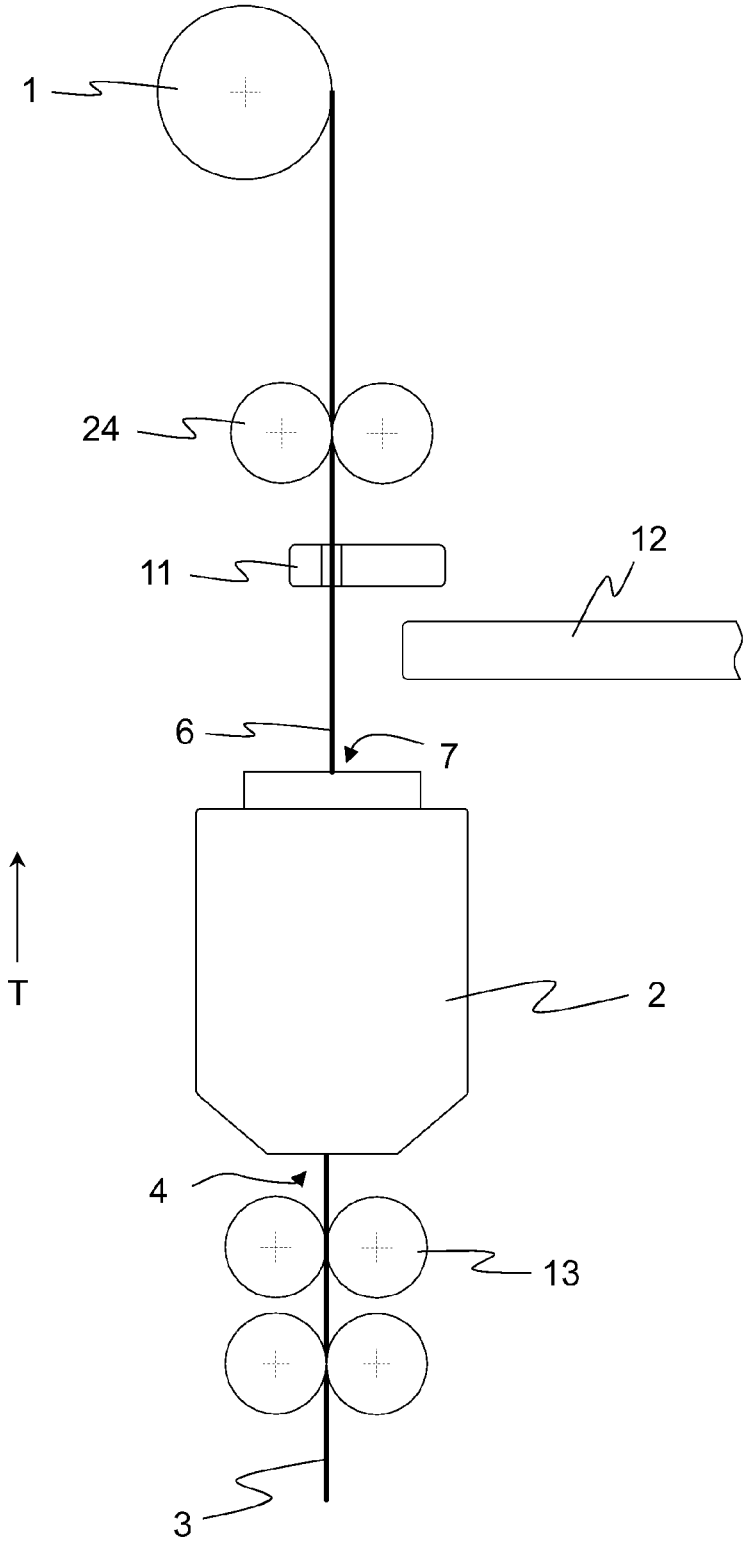
FIG. 1 A side view of a spinning unit of an air jet spinning machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a section of a spinning unit of an air jet spinning machine according to the invention (although, needless to say, the air jet spinning machine can consist of multiple spinning units arranged preferably next to one another). If necessary, the air jet spinning machine can comprise a drafting system with several drafting system rollers 13, supplied with a fiber strand 3 in form of a doubled drawing frame sliver, for example (for better clarity. only one of the drafting system rollers 13 is given a reference sign). Furthermore, the spinning unit comprises a spinning nozzle 2 with a vortex chamber 5 lying inside (see FIG. 2), in which the fiber strand 3 or at least a portion of the fibers of the fiber strand 3 is imparted a twist after passing an inlet 4 of the spinning nozzle 2 (the precise function of the spinning unit is described in more detail below).

In addition, the air jet spinning machine can encompass a draw-off roller pair 24 arranged downstream from the spinning nozzle 2 and a winding device 1 downstream from the draw off roller pair 24 for spooling the yarn 6 that leaves the spinning nozzle 2 on a tube. Likewise, a yarn carry-off unit 12 (driven pneumatically, for example) can also be provided so yarn sections can be carried off during a cleaning cut in which a yarn error is cut out from the yarn 6. The spinning unit must not necessarily have a drafting system. The draw off roller pair 24 or the yarn carry-off unit 12 are not absolutely necessary either.

The spinning unit shown works generally according to an air jet spinning method: To form the yarn 6, the fiber strand 3 is guided in a stipulated transportation direction T to a fiber guiding element 23 shown in FIG. 2, which guides it to the vortex chamber 5 of the spinning nozzle 2 through the opening formed by the above-mentioned inlet 4. There, a twist is imparted to it, i.e. at least one portion of the free fiber ends 10 of the fiber strand 3 (cf. FIG. 4) is snatched by a swirled air current generated accordingly by air nozzles 19 arranged in a vortex chamber wall arranged around the vortex chamber 5 (the air nozzles 19 are supplied with compressed air, preferably via an air supply pipe 18, that ends in an air supply chamber 17 connected to the air nozzles 19). Here, at least some of the fibers are pulled out of the fiber strand 3 and wound around the tip of a yarn forming element 21 protruding into the vortex chamber 5. Owing to the fact that the fiber strand 3 is drawn out of the vortex chamber 5 through an inlet opening of the yarn forming element 21 via a draw-off channel 20 arranged within the yarn forming element 21 and finally out of the spinning nozzle 2 through an outlet 7, the free fiber ends 10 are also finally pulled towards the inlet opening and in the process twist around as so-called wrap fibers around the centrally running core fibers—resulting in a yarn 6 having the desired twist. The compressed air introduced through the air nozzles 19 finally comes out of the spinning nozzle 2 through the draw-off channel 20 and a possibly present air outlet 25, which can be connected to a negative pressure source if necessary.

Generally speaking, it should be clarified here that the manufactured yarn 6 can be basically any fiber strand 3 characterized by the fact that an outer portion of the fibers (the so-called wrap fibers) twists around an inner, preferably untwisted or if necessary twisted portion of the fibers in order to impart the yarn 6 with the desired strength.

Furthermore, an additive supply 8 is allocated to the spinning unit that encompasses one or several additive deposits 15 and one or several, preferably at least partially flexible, additive supply lines 14 through which the corresponding additive deposit 15 is fluidically connected to an additive dispenser 22 arranged in the area of the yarn guiding element 23 or inside the spinning nozzle 2 (with regard to possible additives 9, please consult the description given so far).

Figure 2:
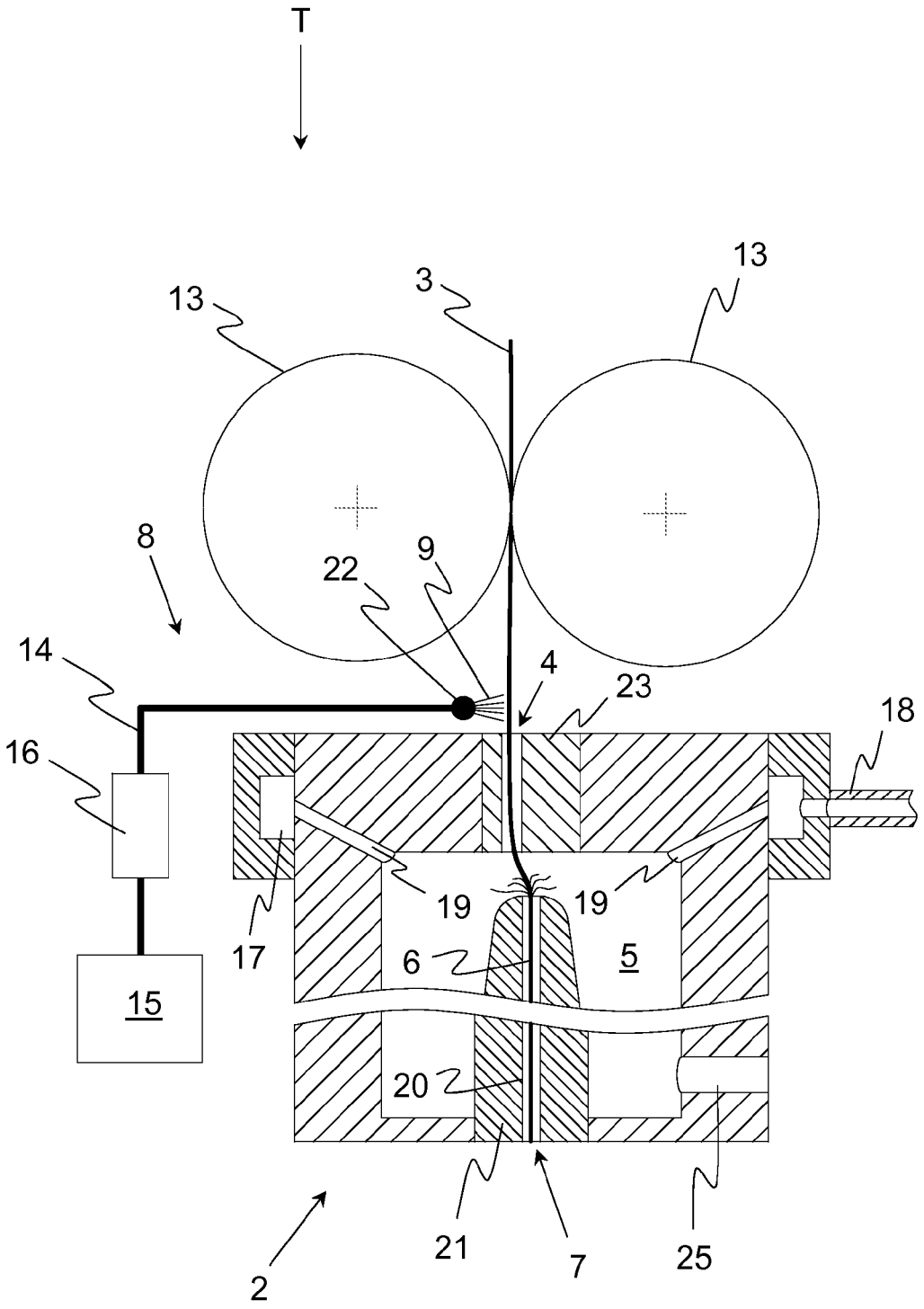
FIG. 2 a partially cut section of a spinning unit of an air jet spinning machine according to the invention.

Basically, the additive 9 can be dispensed in another spot. While FIG. 2 shows an embodiment, in which the additive dispenser 22 is located in the area of the inlet 4 of the spinning nozzle 2 (so that the additive 9 can be applied on the fiber strand 3), the additive 9 can be likewise added through the compressed air introduced by the air nozzles 19. In this case, the dispensing of the additive 9 is done, for example, through the air supply pipe 18 or the above-mentioned air supply chamber 17, which extends, for example, annularly around the wall delimiting the vortex chamber 5 and through which the air nozzles 19 are supplied with compressed air. Finally, it is just as conceivable to introduce the additive 9 through the draw-off channel 20.

So the additive 9 can be delivered precisely and also in a very reproducible way through the additive dispenser 22 and, in addition, so the dispensed volumetric or mass flow of the additive 9 can be adapted to the respective conditions, the additive supply 8 also comprises at least one dosing unit 16, preferably integrated into the corresponding additive supply line 14, so it can be perfused by the additive 1.

Figure 3:
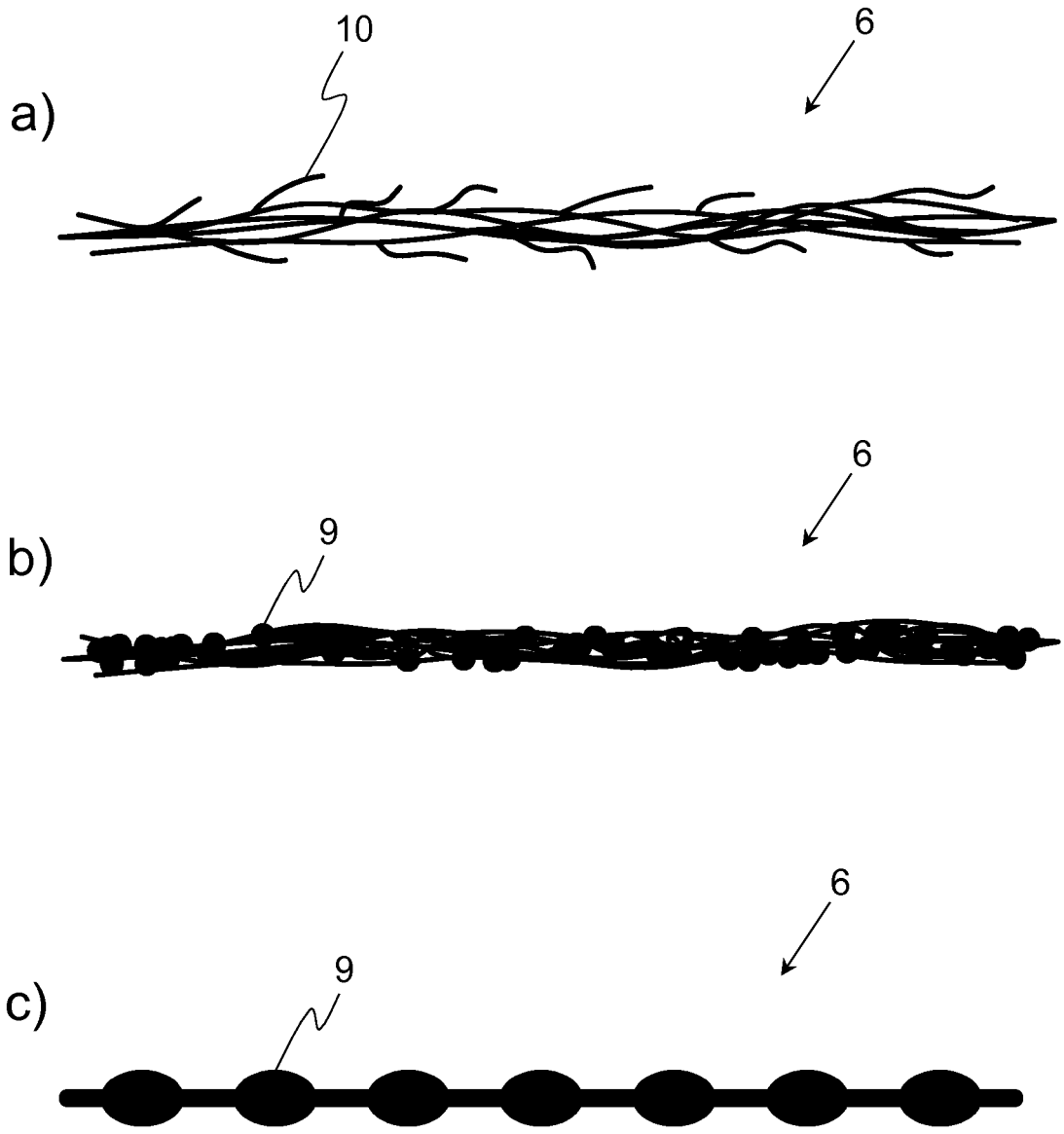
FIG. 3 various yarn sections.

Finally, FIG. 3 shows three yarn sections purely schematically. As shown in FIG. 3*a*), the yarn 6 manufactured during normal operation without the addition of additive is generally characterized by a certain hairiness, i.e. a part of the free fiber ends 10 and loops stick out. On the other hand, if the fiber strand 3 or yarn 6 is moistened with additive 9, then at least some of these fiber ends 10 attach to the remaining yarn body (see FIG. 3*b*)), so that the addition of the additive can be detected with the help of an optical sensor (shown in FIG. 1), since there is less hairiness when additive is added than when it is not added. Therefore, by means of the optical sensor, the quantitative monitoring of the addition of additive is possible during normal and/or cleaning operation (i.e. to check whether an additive 9 was added or not). In this case, the measured variable could be the absorption or reflection of the light emitted by the sensor to the yarn 6. Likewise, the shadow of the yarn 6, caused by the corresponding incident light through the yarn 6, can also be monitored.

Similarly, the mass of the yarns 6 can increase by adding additive, so it could also be detected and also quantitatively monitored by a capacitive sensor of the sensor system 11. Here, the capacitive sensor detects either the intrinsic change in the yarn mass (i.e. the change in the overall mass consisting of the mass of the fiber material of the yarn 6 and the mass of the applied additive 9). Likewise, the capacitive sensor could be designed to detect only the mass of the additive 9 (which can be water, for example). Finally, it is naturally also possible to detect just changes in the monitored parameter(s) instead of absolute values.

To conclude, FIG. 3*c*) shows schematically that the additive 9 can also be provided in form of beads in case the additive 9 is added in pulses. In this case, too, a qualitative and/or quantitative monitoring of the addition of additive (as described so far) would be possible, in which case the monitoring could conceivably take place during normal operation and especially also during the cleaning operation.

The present invention is not restricted to the embodiments shown and described. Modifications within the framework of the invention are just as possible as any combination of the characteristics described, even if they are shown and described in different parts of the description or claims or in different embodiments.

The invention claimed is:

1. A method to operate an air jet spinning machine having a spinning unit with a spinning nozzle for manufacturing a yarn, comprising:

feeding a fiber strand to the spinning nozzle through an inlet during operation of the spinning unit;

imparting a twist to the fiber strand inside a vortex chamber of the spinning nozzle by means of a swirled air current so that a yarn is formed from the fiber strand that leaves the spinning nozzle through an outlet;

with an additive dispenser, feeding an additive to a location either within the spinning nozzle or upstream of the spinning nozzle while the air jet spinning machine is operating, the additive applied to any combination of the fiber strand, the yarn, or on sections of the spinning nozzle;

monitoring a physical parameter of the yarn leaving the outlet with a sensor system; and based on a measured value of the sensor system correlated to the physical parameter, determining if or how much of the additive was applied to the fiber strand or the yarn.

2. The method according to claim 1, wherein manufacturing of the yarn is interrupted by means of a control unit when the sensor system detects that the supplied additive deviates qualitatively or quantitatively from a target value.

3. The method according to claim 1, wherein the sensor system comprises an optical sensor used to monitor a qualitative aspect of the yarn resulting from the additive supply based on the values measured by the optical sensor.

4. The method according to claim 1, wherein the sensor system comprises a capacitive sensor used to monitor a quantitative aspect of the yarn resulting from the additive supply based on the values measured by the capacitive sensor.

5. The method according to claim 4, wherein the additive dispenser supplies the additive in a pulse-like fashion, the quantitative monitoring of the additive supply taking place by evaluating brief mass fluctuations of the yarn detected by the capacitive sensor.

6. The method according to claim 1, wherein the additive dispenser is configured to supply a volumetric flow of the supplied additive is between 0.001 mL/min and 7.0 mL/min, or a mass flow of the supplied additive is between 0.001 g/min and 7.0 g/min.

7. The method according to claim 1, wherein the additive dispenser is configured to supply a volumetric flow of the supplied additive between 0.001 mL/min and 1.5 mL/min during normal operation of the spinning unit, and the volumetric flow of the supplied additive is increased to between 2.0 mL/min and 7.0 mL/min during a cleaning operation of the spinning unit.

8. The method according to claim 1, wherein the additive dispenser is configured to supply a mass flow of the supplied additive between 0.001 g/min and 1.5 g/min during normal operation of the spinning unit, and the mass flow of the supplied additive is increased to between 2.0 g/min and 7.0 g/min during a cleaning operation of the spinning unit.

9. The method according to claim 1, wherein the sensor system is connected to a control unit of the air jet spinning machine and is additionally configured to monitor whether thickness or mass of the yarn lies within predefined limits, the control unit configured to interrupt manufacturing of the yarn upon the predefined limits being not reached or exceeded.

10. The method according to claim 9, wherein a mass flow or volumetric flow of the additive supplied by the additive dispenser during a cleaning operation of the spinning unit is higher than during normal operation, wherein the predefined limits of yarn thickness or mass have different values during the cleaning operation than during normal operation.

11. An air jet spinning machine, comprising:

a spinning unit equipped with a spinning nozzle to manufacture yarn from a fiber strand supplied to the spinning nozzle, wherein the spinning nozzle further comprises:

an inlet for the fiber strand;

a vortex chamber;

a yarn forming element protruding into the vortex chamber;

an outlet for the yarn generated inside the vortex chamber;

an additive supply allocated to the spinning unit and located such that an additive is supplied to a location either within the spinning nozzle or upstream of the spinning nozzle during operation of the spinning unit and applied on any combination of the fiber strand, sections of the spinning nozzle, or the yarn;

a sensor system disposed so as to monitor at least one physical parameter of the yarn leaving the outlet;

a control unit allocated to the spinning unit and in communication with the sensor system, the control configured to determine whether or how much additive was applied on the fiber strand or the yarn based on at least one measured value supplied by the sensor system that correlates with the physical parameter.

* * * * *